US006893143B2

(12) United States Patent
Opolka

(10) Patent No.: US 6,893,143 B2
(45) Date of Patent: May 17, 2005

(54) LAMP, IN PARTICULAR, LOUNGE, TABLE OR POCKET LAMP

(75) Inventor: Harald Opolka, Solingen (DE)

(73) Assignee: Zweibruder Optoelectronics GmbH, Solingen (DE)

( * ) Notice: Subject to any disclaimer, the term of this patent is extended or adjusted under 35 U.S.C. 154(b) by 0 days.

(21) Appl. No.: 10/258,390

(22) PCT Filed: Mar. 15, 2001

(86) PCT No.: PCT/DE01/01009

§ 371 (c)(1),
(2), (4) Date: Oct. 22, 2002

(87) PCT Pub. No.: WO02/02989

PCT Pub. Date: Jan. 10, 2002

(65) Prior Publication Data

US 2003/0095408 A1 May 22, 2003

(30) Foreign Application Priority Data

Jul. 3, 2000 (DE) ..... 200 11 282 U
Nov. 15, 2000 (DE) ..... 200 19 355 U

(51) Int. Cl.[7] ..... F21V 13/10

(52) U.S. Cl. ..... 362/241; 362/208; 362/349; 362/304

(58) Field of Search ..... 362/241, 84, 800, 362/184, 240, 243, 245, 247, 116, 118, 297, 296, 301, 302, 341, 349, 346, 348, 205, 191, 208, 304, 347

(56) References Cited

U.S. PATENT DOCUMENTS 1,903,417 A * 4/1933 Grant ..... 362/304
2,466,414 A * 4/1949 Gits et al. ..... 362/205
4,336,580 A * 6/1982 Mouyard et al. ..... 362/347
4,408,263 A * 10/1983 Sternlicht ..... 362/189
4,417,300 A * 11/1983 Bodmer ..... 362/304
4,502,102 A 2/1985 Phipps ..... 362/184
4,563,728 A * 1/1986 Bruggeman et al. ..... 362/206
4,704,669 A 11/1987 Brunner ..... 362/445
4,907,044 A * 3/1990 Schellhorn et al. ..... 257/98
5,349,509 A * 9/1994 Klug ..... 362/362
5,506,760 A 4/1996 Giebler et al. ..... 362/249
5,642,933 A * 7/1997 Hitora ..... 362/243
5,655,830 A 8/1997 Ruskouski ..... 362/240
5,962,971 A * 10/1999 Chen ..... 313/512

FOREIGN PATENT DOCUMENTS

| | | |
|---|---|---|
| DE | 200 21 934 | 5/2001 |
| EP | 0 389 724 | 10/1990 |
| JP | 59207674 | 5/1983 |

* cited by examiner

*Primary Examiner*—Thomas M. Sember
*Assistant Examiner*—Bao Q Truong
(74) *Attorney, Agent, or Firm*—Herbert Dubno

(57) ABSTRACT

The invention relates to a lamp, in particular, a lounge, table, or pocket lamp with a lamp head (13), comprising a light source (16), arranged in a hollow reflector (17), which extends with the plug-in, or terminal contacts thereof, through an opening in the rear of the hollow reflector. According to the invention, the light source is a light diode (16). The opening in the hollow reflector (17), lies very close to the outline of the cover of said light diode, such that the light diode is centralised and longitudinally fixed in position, relative to said hollow reflector. The hollow reflector has a reflector piece, surrounding the light emitting chip of the light diode; which is at least essentially conical in shape.

16 Claims, 11 Drawing Sheets

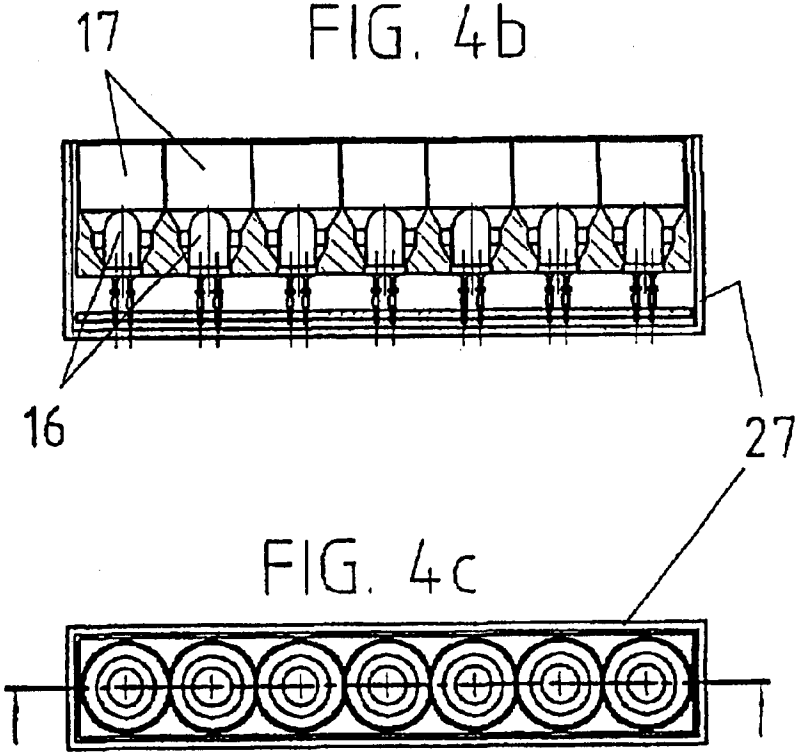
FIG. 4b
FIG. 4c
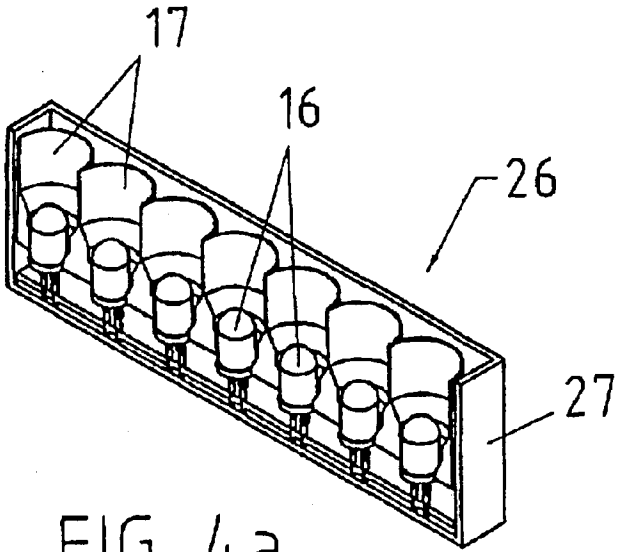
FIG. 4a 28
29

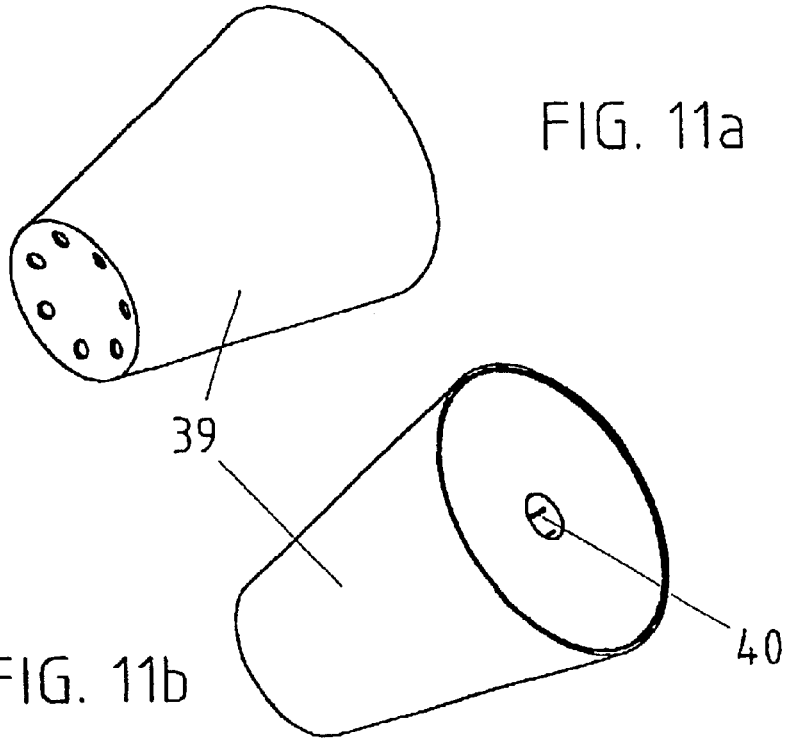
FIG. 11a
FIG. 11b
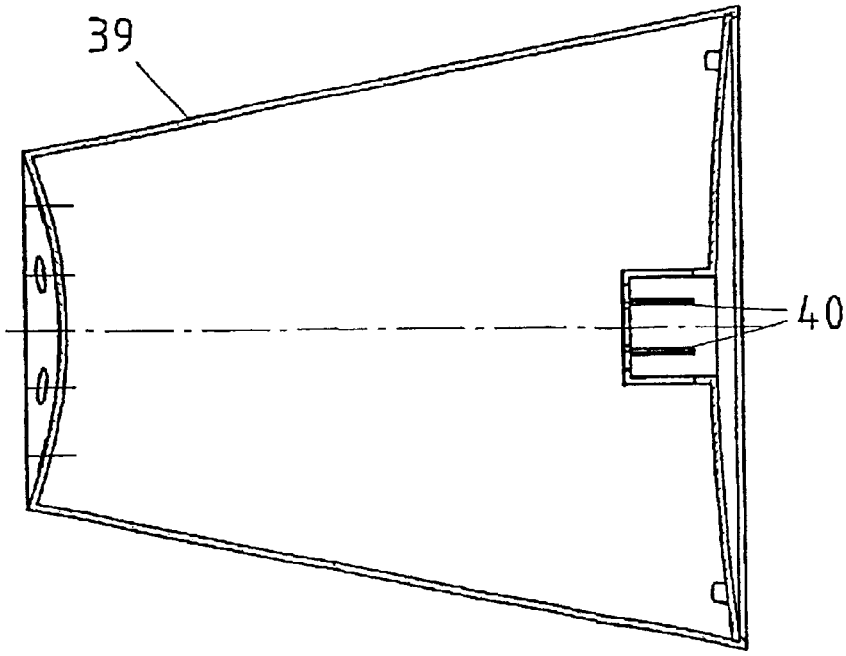
FIG. 11c

LAMP, IN PARTICULAR, LOUNGE, TABLE OR POCKET LAMP

CROSS REFERENCE TO RELATED APPLICATIONS

This application is a natural stage of PCT/DE01/01009 filed Mar. 15, 2001 and is based upon German national applications 20011282.1 of Jul. 3, 2000 and 20019355.4 of Nov. 15, 2000 under the International Convention.

FIELD OF THE INVENTION

The invention relates to a lamp, especially a living room lamp, a table lamp or a pocket lamp with a lamp head which has a liquid source disposed in a hollow reflector and which has plug contacts and/or connecting contacts projecting rearwardly through an opening in the hollow reflector.

BACKGROUND OF THE INVENTION

Living room lamps, table lamps or pocket lamps of conventional construction are equipped with incandescent bulbs which have the drawback that at relatively high current demands, only a relatively small part of the energy consumed is used to produce the light. Indeed, xenon lamps of higher light output or energy-saving lamps with a cost saving are possibly used as house or table lamps but even here, further optimization is desirable.

For pocket lamps or flashlights it is known to dispose the incandescent bulbs generally in the region of the focal point of a reflector of a concave configuration. Usually such reflector is in the form of a so-called parabolic mirror which enhances the light output of the pocket lamp. An incandescent filament of a pocket lamp bulb radiates to all sides in the switched-on state of the lamp so that by reflection, the light which is radiated away from the front opening in the lamp head is redirected by one or more reflections into a substantially longitudinal axial direction and thus is useable. In accordance with the state of the art, there are also pocket lamps known in which a reflector is shiftable in the longitudinal axial direction to produce differently radiating light cones. This shiftability can be achieved either via a longitudinal axially-extending guide, through a translatory shifting or through a rotary movement in which the reflector is shiftable by rotation depending upon a threading pitch. In a corresponding manner the incandescent lamp within a reflector which is rigid with the lamp head can be moved longitudinally axially via a slider or the like which, however, is of expensive construction. The change in the light bundle configuration which is radiated outwardly can, depending upon the reflection of the beam from the incandescent lamp on the inner surface of the reflector, be in the form of a substantially parallel light beam output when the incandescent lamp or its incandescent filament is located at the focal point of the hollow mirror.

From U.S. Pat. No. 4,783,735 a flashlight lamp is known which has a reflector and two incandescent lamps, light-emitting diodes or laser diodes located at different positions by means of which the shadow effect which can arise with only one incandescent lamp, can be avoided. The reflector to achieve this purpose and the transparent cover through which the light emerges are, however, of complex construction since the emitted radiation is perpendicular to the longitudinal axis of the pocket lamp and as a result the lamp can be manipulated only with difficulty.

A flashlight is described in EP 0 921 345 which has, apart from a two-filament incandescent lamp, two light-emitting diodes at the lamp outer shell which achieves the object of enabling the turned-off lamp to be readily recognizable even in the dark if the light-emitting diode has to be turned on. In the meantime flashlights have also become known in which a high light intensity diode serves as the single light source.

OBJECT OF THE INVENTION

It is an object of the present invention to provide a lamp, especially a flashlight, which has the greatest possible light output and improved battery capacity with a reduced requirement for battery power.

SUMMARY OF THE INVENTION

The lamp of the invention comprises as a light source, a light-emitting diode which is surrounded by a hollow reflector whose opening is of the same size as the shell contour of the light-emitting diode which extends through it within the measure of tolerance or with a slight play. The position of the hollow reflector is determined by its outer shell configuration and the configuration of the inner shell of the lamp head and is centered and disposed longitudinally axially in the lamp head. At least the hollow reflector, which is disposed at the level of the light-emitting chip of the light diode is substantially of a conical shape. The described combination of the light diode with the hollow reflector has the following advantages:

For one thing the hollow reflector serves to increase the light output. Indeed the main radiation direction of the light diode is limited to a relatively small conical angle measurement as determined by the shape of the light diode glass body, however the amount of light which is laterally radiated and which without the use of a reflector would be absorbed by the inner shell surface of the lamp head is not insignificant. By contrast, the ability to center the light diode relative to the reflector by shifting the reflector thereover as the light diode projects through the opening of the rear part of the hollow reflector, enables an exact longitudinally axial orientation, the centering being ensured by a slight bending of the wire conductors of the light diode. The hollow reflector itself is centered in the lamp inner shell by a corresponding configuration of its outer shell shape to the matching lamp head inner shell.

As a result the diode glass body below the light-emitting chip is engaged all around by the reflector opening and the diode is also protected from impact. The hollow reflector, from the point of view of its configuration, can have a shape at its reflector side turned toward the diode which is substantially the configuration in accordance with the state of the art since even therewith, there is an increased light output. Preferably the hollow reflector has, however, a cup shape with a conical reflector shell portion at the level of the light-emitting chip.

Thus the hollow reflector has preferably a cylinder shape stepped shell surface which, with a limited play or degree of tolerance, has the same diameter as the stepped cylinder shaped lamp head inner shell whereby the hollow reflector is secured against falling out by the ring-shaped steps of the cylinder hollow parts and a correspondingly formed step of the lamp head inner shell. With its bottom, the shell reflector is braced against a holder for the diode.

Alternatively thereto, the hollow reflector can have also a conically-shaped outer shell which sealingly bears against the identically-shaped inner conical shell of the lamp head annularly with a slight play or degree of tolerance. A security against falling out of this conically shaped shell is supplied by a corresponding abutment at the front end of the lamp inner head shell.

The conically shaped reflector part at the level of the light-emitting light diode chip form with the common hollow reflector and lamp housing longitudinal axis, an angle of 10° to 45°, preferably 30°, whereby the hollow reflector aside from the first reflector part surrounding the light-emitting chip of the light diode, in the region of the greater cone diameter, has a second conically-shaped shell part which is arranged parallel thereto.

In the first shell part, the light which is emitted from the light point sideways, i.e. radially emitted light, is reflected forwardly, that is toward the opening of the lamp head. Some further stray light component in the radial direction which is radiated sideways from the tip of the light diode glass body, is reflected from the second conically-shaped shell part in a corresponding manner. Between the first and the second conically shaped shell parts, a cylindrically shaped shell part can be located. This interrupted conical shape has the advantage of a reduced diameter which is especially desirable for flashlights in a miniature format. With diodes that are available on the market, stray light components emerge in the radial direction at substantially the height of the light-emitting chip and at the front dome-shaped glass body tip, by comparison to which light emissions in the remaining regions of the glass body are negligible. The described conically shaped cylindrical configuration constitutes an ideal compromise between the smallest possible reflector diameter and the optimum light output. The hollow reflector can be so configured that it projects only slightly beyond the forwardmost diode glass end and/or such that a light-emitting diode is disposed at least 0.5 cm rearwardly to the open end of the lamp head. The latter variant is especially effective when the diode is to be protected from external impact and shock effects or other mechanical injury.

Idealwise, the opening of the hollow reflector at the rear bottom side has a ring-shaped enlargement for receiving the lower diode glass body base step.

The ideal reflector can additionally have detent means at its bottom periphery which can engage around the diode bottom from the back side. Such detect means ensures that the hollow reflector after being shoved onto the diode body will be fixed thereto so that optionally other fixing elements or abutments for the hollow reflector along the longitudinal axis can be avoided.

Generally the aforedescribed embodiment can be used as a flashlight, here especially as a bar-shaped flashlight, but also as a table or living room lamp. Instead of a battery current supply the voltage required for operation of the diode can be supplied optionally by a transformer which can be fed by a conventional plug (220 volts or 110 volts).

For all of these embodiments, diodes are used with the advantage that, by comparison with conventional incandescent lamps, utilize 13% of the energy for the same brightness.

If a greater light amplitude is desired, according to the invention, a plurality of light diodes can be integrated in the lamp head in accordance with the present invention, whereby each light-emitting diode is associated with an individual reflector, in which the light-emitting diode is centered, and a number of reflectors are arranged in a honeycomb pattern in a single body with an outer shell matched to the lamp head inner shell. The configuration of the individual hollow reflectors and the positions of the diodes in the reflectors corresponds to the aforedescribed configuration. The honeycomb-like assembly of the reflectors has an outer shell profile which can be so shaped that it is matched to the inner shell of the lamp head. Possible intermediate spaces which can arise from the provision of mutually adjoining rows of circular profiles in cross section can be filled in by injection molding techniques in the manufacture of the assembly so that the outer shell profile of the resulting one piece body is for example circular, elliptical or of another shape.

According to a further feature of the invention, the individual reflectors are not fixed but are swingable through an angle up to 45° preferably up to 30°. In this manner, the radiating direction on several units (reflectors with diode) can be adjusted as is already basically known with house lighting units with conventional radiators. The individual reflectors (with their respective diodes) can be assembled next to one another along a line which can be an arc, a circle, or an arrangement which is rotation symmetrical about a central point or in an optional geometric contour.

Especially insofar as the lamp according to the invention is configured as a flashlight, the bar-shaped lamp housing configuration has a number of advantages. For one thing, the bar-shaped lamp can be fabricated in a miniature format whose size corresponds substantially to that of the batteries used and which provides surfaces for the arrangement of the switch. If one utilizes instead of a push-button or slide switch a rotary switch which can be arranged on the lamp housing cover, the lamp radius can be further minimized.

For longer or larger-diameter bar shapes, it is possible to shave the bar-shaped lamp into a ring-shaped or cylinder-shaped holder of a lamp shade so that the lamp as required, can be useful as a table or living room lamp or as a flashlight. An earlier drawback has been that conventional diodes either emit only (approximately) monochromatic light, for example, blue, red, green or orange) or emit mixed colors comprised of reds, blue and green which can only approximate the character of "white light". The latter is however only possible when one utilizes a plurality of diodes with different emission spectra.

To overcome this problem with such light-emitting diodes, the light-emitting LED chip can be embedded in a synthetic resin mass containing fluorescent or phosphorescent particles. Fluorescence and phosphorescence are physically treated together as so called luminescent properties; the substantial difference resides only in the light duration. By luminescence effects luminescent particles are excited by the light-emitted from the LED chip (for example in a blue color corresponding to about 480 nm). The absorbed radiation is then completely or partly reradiated in a more or less short time whereby however the emitted light is at most as short-lived as that which is absorbed. This results in a spectral shifting of the light to the luminescent particles emitted light (relative to the primary emissions stemming from the light-emitting diode). The primary radiation and the luminescent radiation gives rise to an additive spectral pattern with increased light intensity and visible as a mixed color. The drawback of the earlier investigations involved in bringing luminescent particles into the vicinity of a LED chip was that the reduced temperature increase in the light diode gave rise to variations in the radiating character of the LED chip and, in other words, a radiated color of such LED which was not temperature stable.

To overcome this according to a feature of the present invention, the light-emitting diode glass body is coated with a layer in which luminescent particles of fluorescent or phosphorescent material is embedded in synthetic resin (preferably an acrylic). Differing from the conventional investigations, the luminescent particles are brought into the vicinity of the chip in the form of a coating on the glass body so that because of its greater spacing from the LED chip, does not have a significant effect on the temperature characteristics. The coating in question can be applied by spraying or by means of an immersive process in which in the latter the diode is briefly immersed in a heated liquid solution of the liquid synthetic resin doped with dissolved luminescent particles. The coating thickness which is desired can be achieved by repeating the immersion process a plurality of times. Preferably for such coatings xenon light-emitting diodes are used which transmit a relatively bright but cold white-blue light. To make the radiation "warmer" for example, a xenon diode can be provided with a coating which appears orange and in which via the described luminescence effect can result from a color shift.

According to a further configuration of the invention it is possible to provide the lamp head at the front with a cover which has the configuration of an optical collecting lens. From the geometric optics the light refractive lens can apply as is also known, to produce a bundle of rays from a light source using the collective lens, but it is surprising how sharp the contours of the light produced by light-emitting diodes are by comparison to the light from an incandescent coil of an incandescent lamp. The contour sharpness remains even with slight shifting of the light-emitting diode out of the collecting lens focal point. The collecting lens can be composed of glass or a transparent synthetic resin.

Finally, on the shell surface of the lamp housing which can be provided with a push-button or slide switch, a clip can be mounted to protect the switch against undesired actuation. The clip can be rotatably or slidably affixed on the lamp housing surface or removable to free the push-button or slide switch for operation or for pressing down the push-button switch. Basically clips are known for writing instruments and also for flashlights but they serve exclusively as means for fastening onto a belt buckle, a trouser waistband or a jacket pocket, etc. The present invention, by contrast, enables the possibility of using the clip to securely cover the switch as required. The removability, rotatability or shiftability of the clip on the outer surface of the housing enables at least two different clip positions to be provided on the flashlight housing surface, whereby in the first case the clip serves exclusively as a cover for the switch and in the second case optionally as a holder for fastening the flashlight to a garment or other auxiliary means. Rotatability or shiftability of the clip allows selection in the sense that the clip position relative to the flashlight housing can completely expose the switch or enable the clip to resiliently press with its free front end upon the push-button switch. In the latter case, the push switch can be purely a resilient contact switch for which no latching mechanism is required. Thus the clip can comprise a one-piece body having a part that passes at least partially around the housing periphery and additionally is stressed thereagainst and is a ring or partial ring profiled body. Optionally the ring or partial ring profiled body can lie in a groove of the housing jacket rotatably so that longitudinal or axial shifting of the clip is precluded. By contrast with full spring loading ballpoint pens and similar devices, the ring or partial ring profiled body may be rotatable around the longitudinal axis of the bar-shaped housing.

According to a further configuration of the invention, the clip has a strip-shaped flat body on the free end of which a spacer element is arranged which together with the fastening point of the flat body at the opposite end (namely on a ring or partial ring profiled body) ensures a minimum spacing of the flat body from the outer periphery, whereby this spacing is greater than the maximum rise of the pressure switch relative to the housing periphery. Optionally, taking into consideration the spring elasticity provided for the clip, this construction ensures that even under a high external pressure against the housing wall or on the ring or partial ring profile surface turned toward the pressure or slide switch, a spacing will remain. The spacing element can be used however for a longitudinal shifting of the clip and for holding down a pressure switch configured as a pure contact switch.

Advantageously, a partial ring profiled body is used which is resiliently elastic and thus spreadable. Such a partial ring profile body can either be shifted in the longitudinal axial direction relative to the pocket lamp housing to the end and then be removed or by tilting be pulled from the flashlight housing. With these variants, it is possible to bring the clip into a position 180° rotated from that described when a radiation of the light cone in the opposite direction is desired. In that case, the planar flat and the ring profile or partial ring profile unit can also be easily replaced when for example the flat profile portion of the clip breaks away from the (partial) ring profile at the connecting locations.

BRIEF DESCRIPTION OF THE DRAWING

Embodiments of the invention are illustrated in the drawing. In the drawing:

FIGS. 4*a* to 4*c* show an embodiment of the invention with seven individual reflections surrounding respective light-emitting diodes in three views;

FIGS. 11*a* to 11*c* show three views of a lamp shade with a holder for receiving a bar-shaped lamp;

SPECIFIC DESCRIPTION

Figure 1:
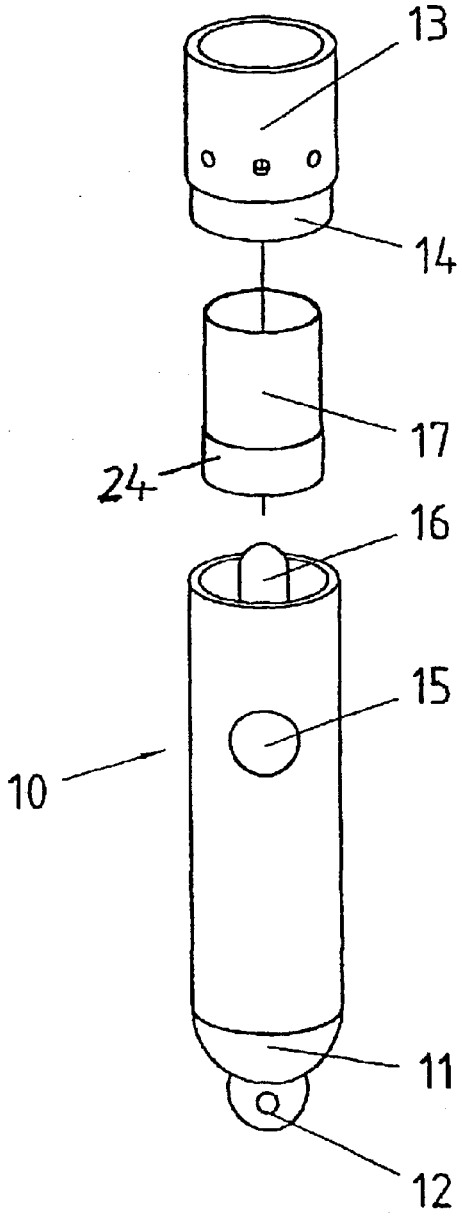
FIG. 1 shows a flashlight in accordance with the invention with a lamp head, the hollow reflector and the lamp housing in an exploded view.
Figure 2:
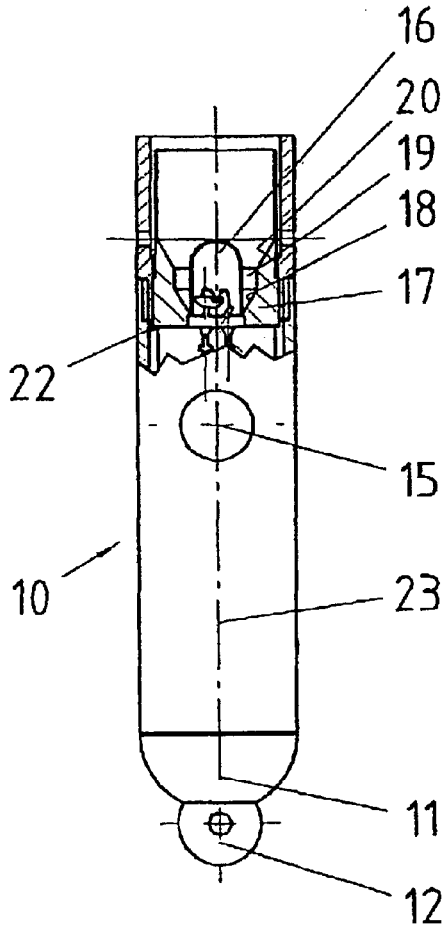
FIG. 2 is a partially sectioned elevational view of a flashlight according to the invention in the assembled state.

The illustrated flashlight of FIGS. 1 and 2 comprises a bar-shaped lamp body 10 which has an inner hollow space forming a battery receptacle closable at its rear end by a cover 11. Optionally a replacement diode can also be releasably clipped into a corresponding profile in this cover. On the cover itself a ring-shaped eye 12 is located to which a chain or the like can be fastened by a snap hook. At the front end a lamp head 13 is arranged which is configured as a hollow body and has an external screwthread 14 which can be screwed into a correspondingly-shaped internal thread of the lamp body 10. The flashlight has an on and off switch 15 by means of which the diode 16 can be switched on and off. The diode can either be monochromatic, for example blue or red light, or also an approximately white light emitter. The key to the present invention is the hollow reflector 17 whose outer shell surface or outer peripheral surface is of cylindrical configuration and has a diameter which corresponds to the internal diameter of the lamp head 13 so that the lamp head without significant force can be shoved over the hollow reflector outer periphery. The reflector outer periphery and the lamp head inner shell have, in addition, an annular abutment which prevents the reflector from falling out of the lamp head.

The diode can optionally be provided with a coating which consists of an acrylic plastic with luminescent particles embedded therein. The particles in question can be fluorescent or phosphorescent and effect a change in the light color of the diode. Depending upon the luminescent particles selected and their emission spectrum, this emission spectrum can be superimposed upon the radiation coming from the light-emitting diode chip so as to produce, with the light-emitting diode radiation a new "mixed color." The spectral superimposition is effected toward higher wavelengths, that is in each case to "warmer light." The diode 16 can especially be a xenon diode provided with a coating which is today relatively costly in the marketplace.

Figure 3:
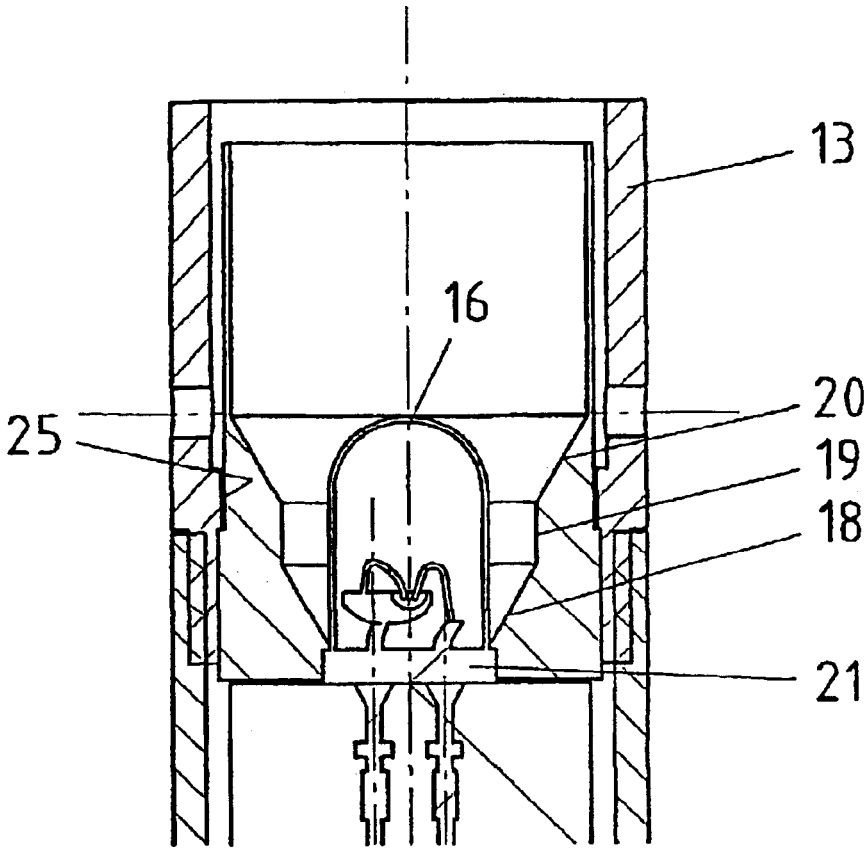
FIG. 3 is a sectional elevational view of a lamp head according to FIG. 2.

As is especially apparent from FIGS. 2 and 3, the hollow reflector has a central passage through which the diode 16 is inserted in a friction-tight manner. The reflector surface turned toward the diode is a cup-shaped configuration.

The hollow reflector has a first conically-shaped surface portion 18 approximately at the height of the light-emitting diode light point (or region) to which a cylindrically-shaped surface 19 is connected and to which in turn another conically-shaped second surface portion 20 is connected. The conical and cylindrical portions 18 and 19 or their surfaces form with the common hollow reflector longitudinal axis and lamp longitudinal axis an angle of 30°. In practice, this multistage hollow reflector is optimal with respect to the emitted radiation light intensity. Aside from the pure light-reflecting characteristics of this hollow reflector, there is also the advantage that the diode is not only held but also is reproducibly centered thereby so that it is always reproducibly in the same position so that light losses can be largely eliminated.

The reflector 17 has, further, in the region of its passage a ring-shaped enlargement to receive the lower step formed by the diode glass body base 21 (FIG. 3).

The hollow reflector 17 is braced against a ring-shaped step 22 on the pocket lamp head inner shell (FIG. 2). In addition, the hollow reflector 17 has a diameter-increasing shell part 24 which engages an annular shoulder 25 on the lamp head inner surface and thus prevents the reflector from falling out of the lamp head.

The parts shown in FIG. 1 can be assembled in the following manner for instance when the diode 16, which is mounted on a plate (not shown) by its plug contacts, is to be replaced. Depending upon whether the reflector sleeve is exclusively braced against the aforedescribed step 22 of the shell inner side in the lamp head 13 or is also arranged on the upper inner edge of the lamp body 10 or whether the reflector outer shell 17 has on its lower end a partial shell piece with an enlarged radius for a wide groove-shaped recess in the lamp shell inner head, initially the reflector with its passage is fitted over the diode 16 and then over the reflector outer shell of the lamp head 13 which can then be screwed together with the lamp housing 10. In the other case, the reflector is initially fitted into the lamp head and then the thus resulting unit is fitted over the diode 16 and the lamp head screwed together with the lamp housing. In the last-mentioned case, the falling out of the reflector 17 is prevented by the ring machined on the lamp head inner shell or by some other such abutment.

The illustrated pocket lamp has a small-size format and can have a total length of less than 6 cm with an outer diameter of less than 1.5 cm. This pocket lamp can easily be supplied as a key holder.

In FIGS. 4*a* to 7*k,* further lamp configurations according to the invention have been illustrated. In each, instead of a single diode, there is a respective plurality of diodes used as the light source. Each of the diodes is surrounded by a reflector. For each of these diode and reflector partial units, the aforedescribed relationship apply.

FIGS. 4*a* to 4*c* show a lamp 26, which is comprised of seven individual diode-reflector partial units which are arranged alongside one another. The reflectors 17 lying alongside one another are connected with one another so that the 7 diode-reflector row forms a pocket unit which is surrounded by a lamp housing 27. By contrast with incandescent lamps, which require a substantial amount of space not only because of the size of the light sources but also because of the corresponding heat development, the diode-fitted light can have a many times smaller structure. Because of the elimination of size restrictions, optional design form can be achieved.

Figure 5B:
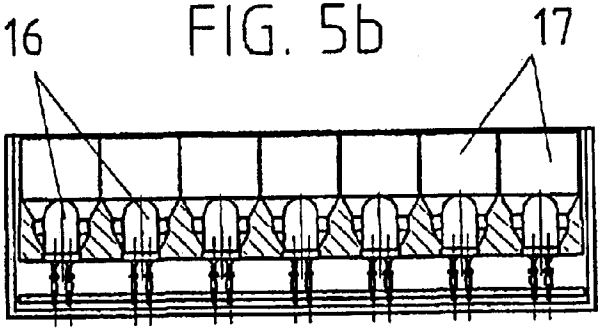
FIGS. 5*a* to 5*c* show a lamp with 14 light-emitting diodes in three views.
Figure 5C:
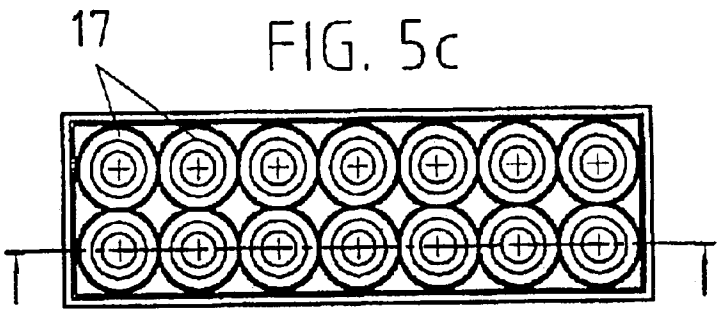
Figure 5A:
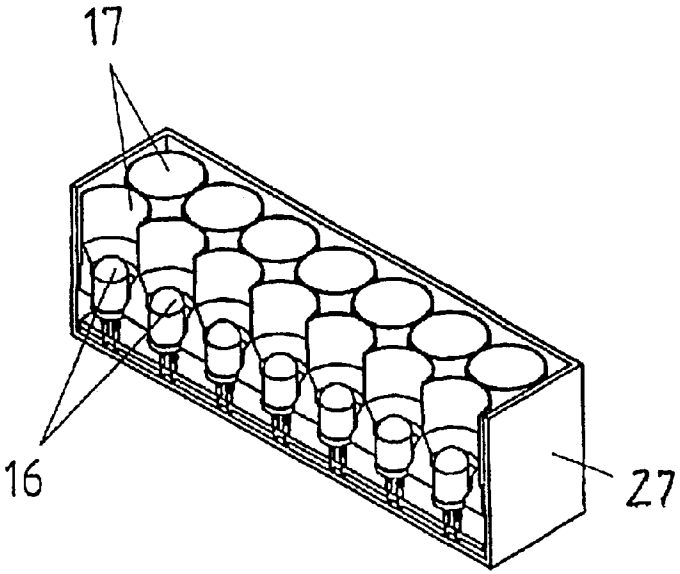

FIGS. 5*a* to 5*c* show a lamp with fourteen light-emitting diodes, each of which is disposed in a reflector 17. Such a lamp has a high lighting power for a reduced space requirement.

Figure 6:
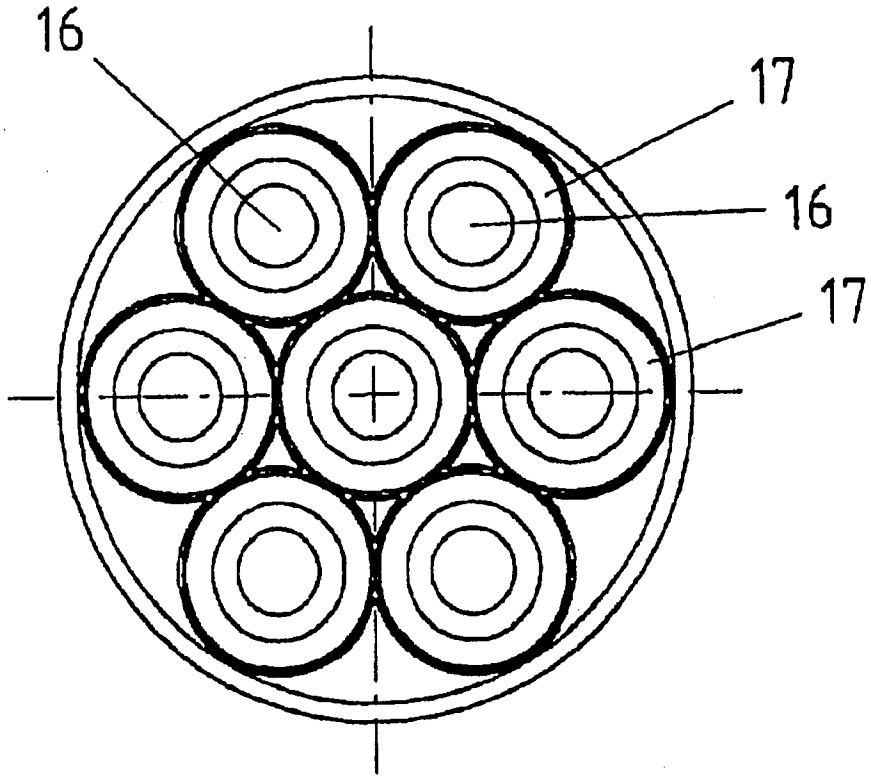
FIG. 6 is an end view of a lamp with a rotational cylindrical arrangement of seven diodes with respective reflectors.

FIG. 6 shows a lamp in which, around a central diode 16 with a reflector 17, in a ring, there are six further diodes 16 with reflectors 17. This lamp allows expansion to larger radii by further circular arrays of diodes in an optional manner which is basically known with multi-phase lighting media, the diodes or diode groups can individually switchable so that selectively in accordance with need, only a part of the diode can be switched on. In principle, it is possible within the framework of the present invention to have the switched-on diodes also form predetermined patterns or the like.

FIG. 7*a* to 7*k* show different lamp configurations in which, respectively, multiple diode-reflector units of the aforedescribed type can be used. The arrangement of the light-emitting diodes in a predetermined pattern in space in their number can depend upon requirements, namely, the desired light amplitude, the spatial geometry of the use purpose of the lamp. It is also advantageous, optionally in the space provided, to use a plurality of light units singularly arranged in a light tray which can form a kind of spotlight.

Figures 7A, 7B, 7C, 7D, 7E, 7F, 7G, 7H, 7I, 7J, 7K:
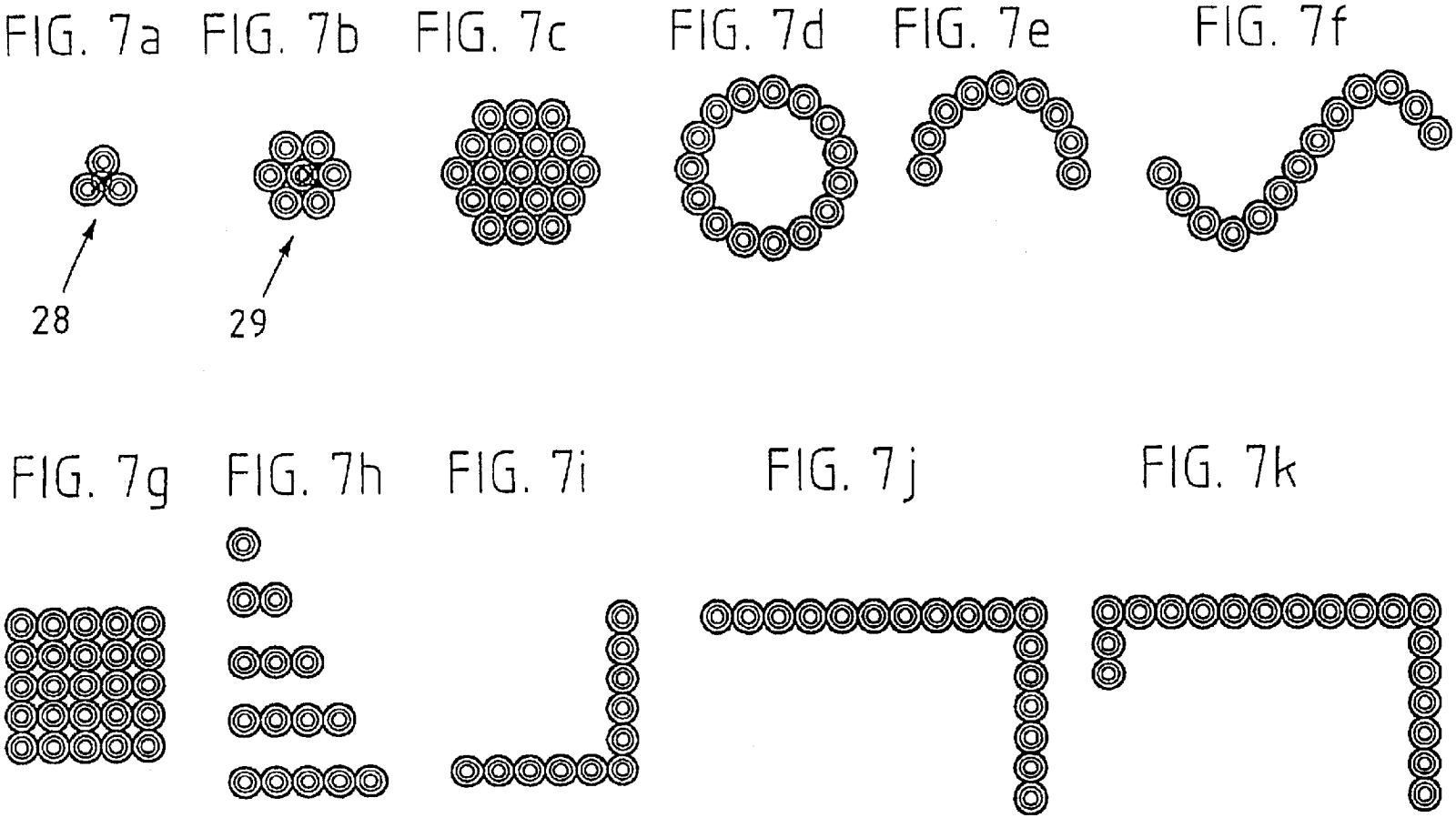
FIGS. 7*a* to 7*k* are end views of various lamps with respectively different multiple light-emitting diodes in different geometrical patterns.

FIG. 7*a* shows a lamp 28 with three diodes arranged in a star pattern and each of which is surrounded by a reflector. Such a triad grouping can be formed in a small space, for example also in the lamp head of a bar-shaped flashlight. The same also applies to the arrangement 29 of FIG. 7*b* in which the seven light-emitting diodes have respective reflectors and are assembled in a unit.

The system allows, as shown in FIGS. 7*c* and 7*g* in greater detail, optional orientation of multiple light-emitting diodes in rows, whereby the assembly of the light-emitting diodes of FIG. 7*c* corresponds to a substantially hexagonal shape or also corresponding to FIG. 7*g* to a rectangular or other polygonal shape. The light-emitting diodes can also, as illustrated in FIG. 7*d,* be arranged in a crown pattern or in a semicircular pattern (see FIG. 7*a*) or along an arcuate line (FIG. 7*f*). The form of FIG. 7*f* allows such shapes to be achieved that can have the configuration of patterns of the carrier along which the respective diode reflecting unit are arranged and flexibly, i.e. with the arcuate shape changing within certain limits.

Further geometric possibilities are indicated in FIG. 7*h* in which an increasing row sequence and spacing is indicated linewise of, beginning with a single diode to five diodes, whereby a lighting body with a corresponding profile can be obtained. Similarly, the right angle profile of FIGS. 7*a*, 7*j* and 7*k* can be created. It is apparent that because of the smallness of the lights, geometric forms can be created which (like self-illuminating digital displays known in principle) permits the formation of letters, numerals, figures and even movable images.

Also while aforedescribed examples are provided, the individual diodes with their correspondingly associated reflectors can be arranged in a plane, it is also possible by contrast to provide the diodes and reflectors in several planes, for example in a pyramid-stepped shape. The light-emitting diodes used in connection with such light sources can all have the same or different emission spectra.

Figure 8:
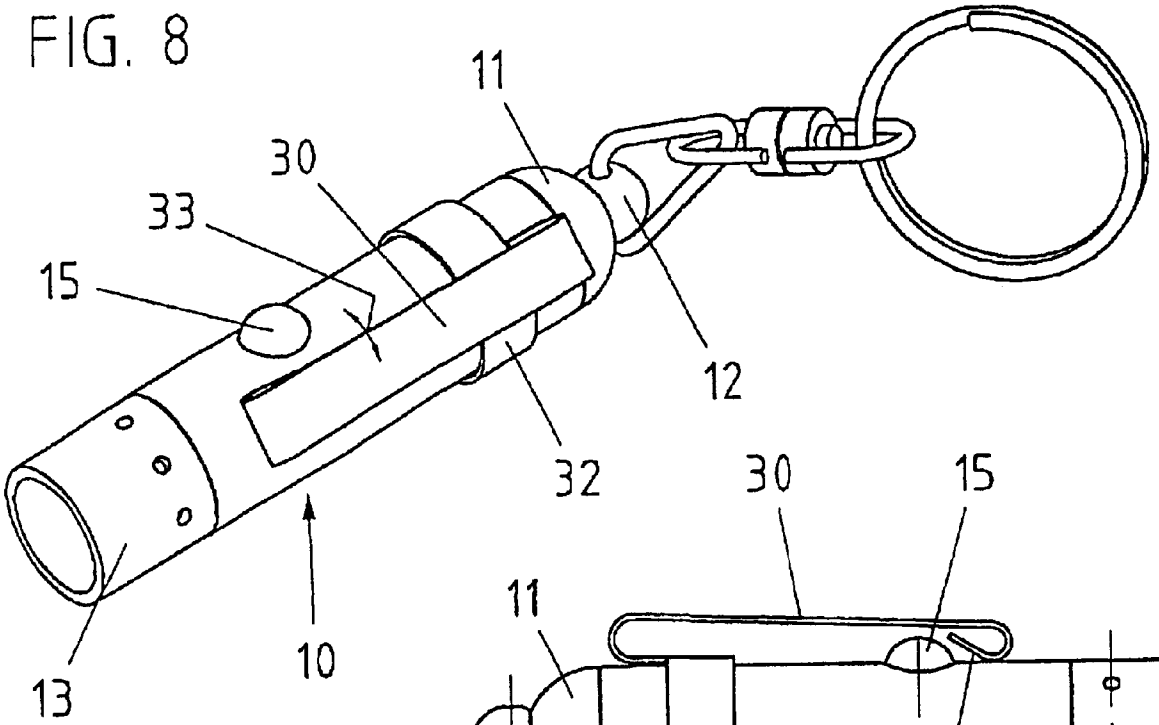
FIGS. 8 and 9 are two views of a bar-shaped flashlight with a rotatable clip as a cover for the push-button switch.
Figure 9:
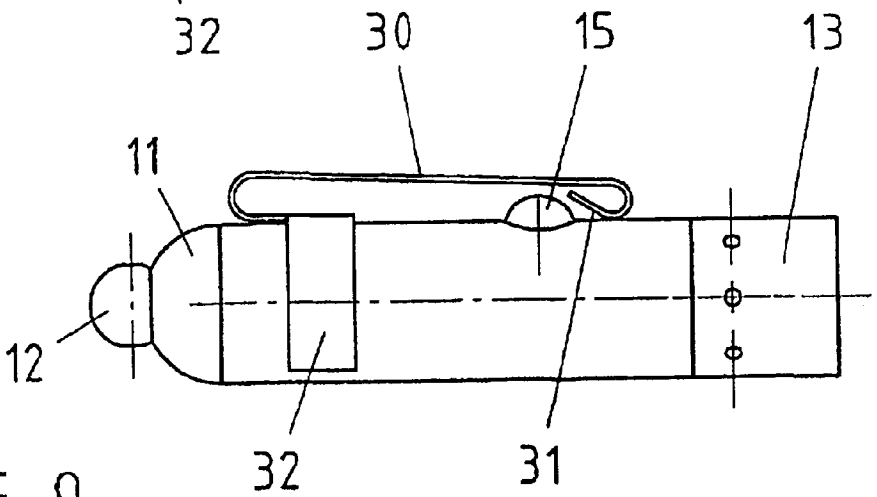
Figure 10:
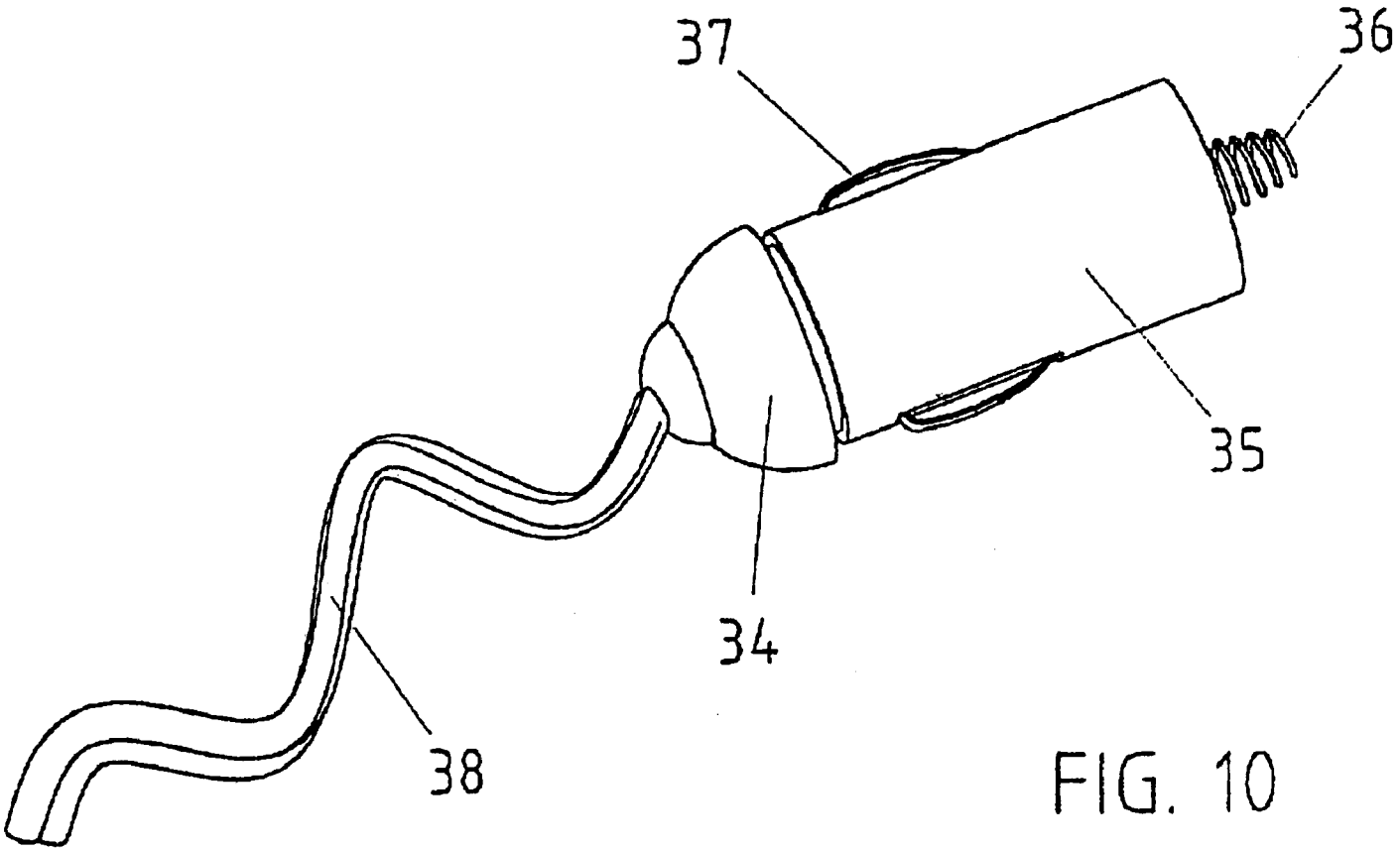
FIG. 10 is an elevational view of a pocket lamp cover part with an extended contact inner part.
Figure 12C:
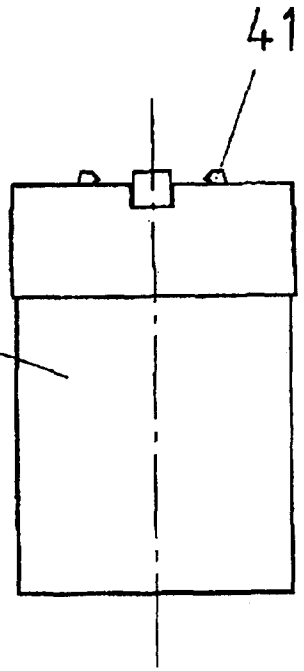
FIGS. 12*a* to 12*c* show three views of a reflector with a clip fastening for a diode.
Figure 12B:
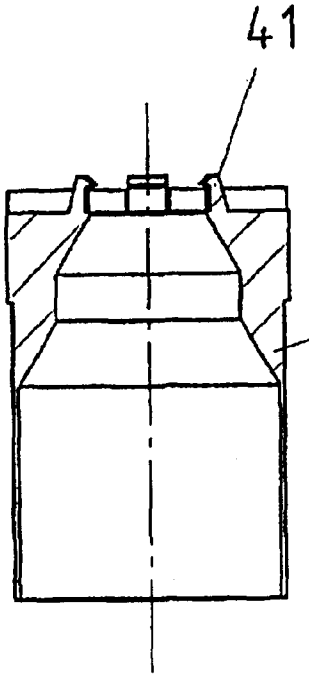
Figure 12A:
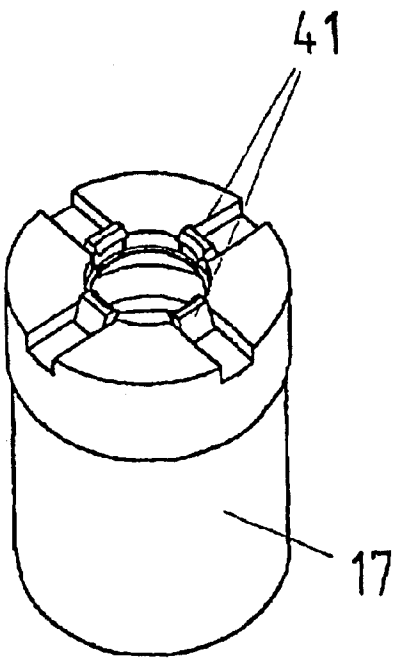
Figure 13:
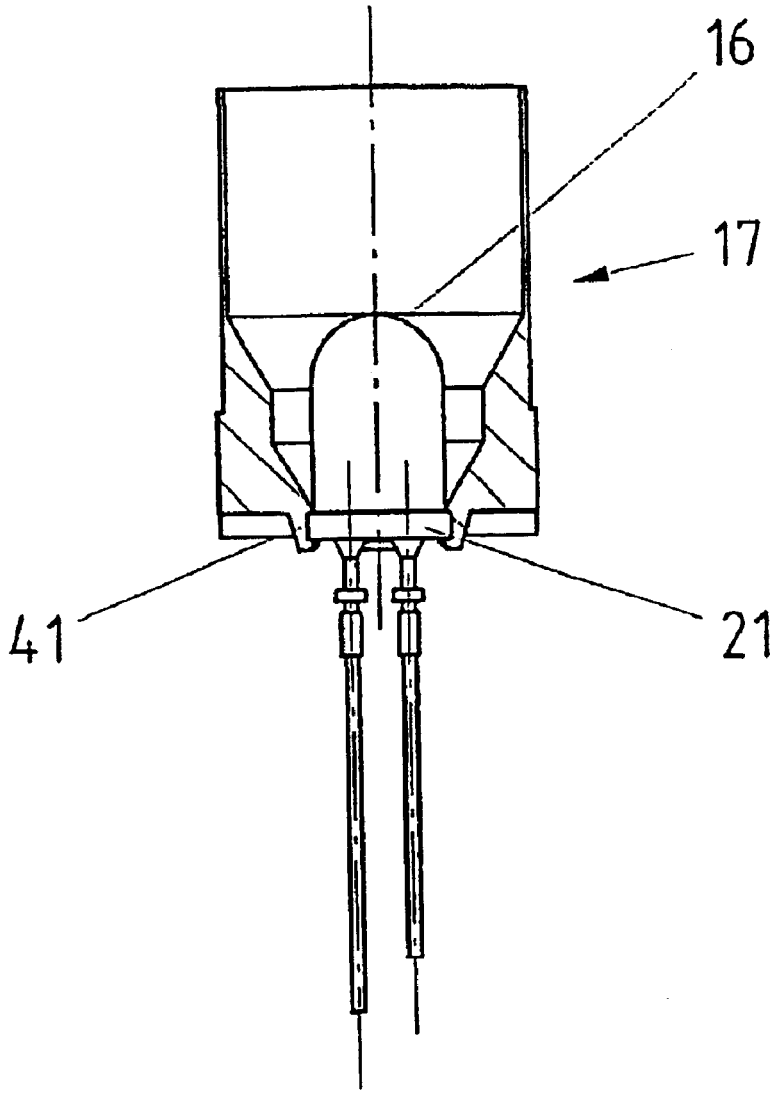
FIG. 13 is a cross sectional view of a reflector and a diode which are secured together by the clip fastening.

The flashlight shown in FIGS. 8 and 9 corresponds in its construction to the small-format bar-shaped flashlight of FIGS. 1 and 2. Identical parts have been provided with identical reference characters. The lamp 10 comprises a clip 30 which is comprised of a strip-shaped flat body and at whose free end a spacer element 31 is arranged. At its opposite end the clip 30 is provided with a partial annular body 32 which rests under a bias against the housing outer surface and encompasses the latter over an angular region which is significantly more than 180°, for example 220° to 270°. The partial ring segment profiled body 32 is however not rigidly connected with the lamp housing but rather is rotatable as is apparent from the double-headed arrow 33. In the position shown in FIGS. 8, clip 30 is so rotated that the push-button switch 15 is exposed and can be actuated by the user. To secure the push-button switch 15 (after the flashlight has been turned off) against undesired actuation, clip 30 together with the partial ring profile body 32 is so shifted or rotated that the clip 30 assumes the position shown in FIG. 9 in which it covers the push-button switch 15. The clip underside is spaced from the push-button switch 15 so that there remains a gap even if there is slight bending of the clip 30.

What is claimed is:

1. A lamp comprising:

a lamp head; a light source in said lamp head;

a hollow reflector in said lamp head and receiving said light source, said light source having contacts projecting rearwardly through a passage of the hollow reflector, the light source being a light-emitting diode, the passage in the hollow reflector being of the same size as a peripheral contour of the light-emitting diode within a slight play or tolerance, the position of the hollow reflector being singularly determined by an outer peripheral shape thereof and the configuration of a lamp head inner surface and being also centered and positioned along a longitudinal axis of the lamp head, the hollow reflector surrounding a light-emitting chip of the light-emitting diode in a ring with at least a substantially conically-shaped first reflector part, said conically-shaped first reflector part forming an angle of 10° to 45° with said axis, the hollow reflector having in a region of larger conical diameter, a second conically-shaped reflector part parallel to the first reflector part, and between the first and second parts a cylindrically-shaped shell part is, whereby the hollow reflector projects only limitedly beyond the front diode glass end and/or the light-emitting diode is arranged at least 0.5 cm behind the open end of the lamp head.

2. The lamp according to claim 1 wherein the hollow reflector is formed as a body which has a cylindrically-shaped stepped outer shell surface which is of the same diameter within a limited play or tolerance as a stepped cylindrically shaped lamp head inner surface, whereby the hollow reflector is secured against falling out by a ring-shaped step of the cylinder shell part against a correspondingly formed step in the lamp head inner surface.

3. The lamp according to claim 1 wherein a conically-shaped outer surface which sealingly engages annularly on an identically-shaped inner conical surface of the lamp head, within a limited play or tolerance.

4. The lamp according to claim 1 wherein the passage in the hollow reflector has at a bottom rear side thereof a ring-shaped enlargement for receiving a lower diode glass body base step.

5. The lamp according to claim 1 wherein, a plurality of light-emitting diodes are disposed in the lamp head, whereby each light-emitting diode has an individual reflector associated therewith within which the respective diode is centered and that the number of reflectors is arranged in a honeycomb shape and are integrated to a one-piece body with outer shells matched to the lamp head inner shell.

6. The lamp according to claim 5 wherein the one-piece body has a shell profile that is matched to the inner shell of the lamp head.

7. The lamp according to claim 5 wherein the individual reflectors are arranged one next to another along a line, an arc, a circle, or rotationally symmetrically about a central point.

8. The lamp according to claim 1 wherein said head is provided on a lamp body of bar-shape configuration adapted to be fitted into a ring-shaped or cylinder-shaped mounting of a lamp shade.

9. The lamp according to claim 1 wherein the light-emitting diode has a glass body is provided with a coating containing luminescent particles.

10. The lamp according to claim 9 wherein the light-emitting diode is a xenon diode.

11. The lamp according to claim 1 the lamp head has a front cover which is of the configuration of a collecting lens.

12. A lamp comprising:

a lamp head;

a light source in said lamp head;

a hollow reflector in said lamp head and receiving said light source, said light source having contacts projecting rearwardly through a passage of the hollow reflector, the light source being a light-emitting diode, the passage in the hollow reflector being of the same size as a peripheral contour of the light-emitting diode within a slight play or tolerance, the position of the hollow reflector being singularly determined by an outer peripheral shape thereof and the configuration of a lamp head inner surface and being also centered and positioned along a longitudinal axis of the lamp head, the hollow reflector surrounding a light-emitting chip of the light-emitting diode in a ring with at least a substantially conically-shaped first reflector part, the hollow reflector having on a bottom periphery thereof, detent means which engages the diode bottom from the rear.

13. The lamp according to claim 12 wherein at least one reflector is swingable about an angle up to 45°.

14. A lamp comprising:

a lamp head;

a light source in said lamp head;

a hollow reflector in said lamp head and receiving said light source, said light source having contacts projecting rearwardly through a passage of the hollow reflector, the light source being a light-emitting diode, the passage in the hollow reflector being of the same size as a peripheral contour of the light-emitting diode within a slight play or tolerance, the position of the hollow reflector being singularly determined by an outer peripheral shape thereof and the configuration of a lamp head inner surface and being also centered and positioned along a longitudinal axis of the lamp head, the hollow reflector surrounding a light-emitting chip of the light-emitting diode in a ring with at least a substantially conically-shaped first reflector part, said lamp having a lamp housing provided on a periphery thereof with a pressure or slide switch protected against unwanted actuation by covering it with a clip which is mounted on the lamp housing for rotation or sliding movement or releasably to uncover the switch or to hold down the switch.

15. A lamp comprising:

a substantially cylindrical lamp body forming a battery housing;

a lamp head receivable on an end of said body;

a light source comprising at least one light-emitting diode received in said lamp head, said light-emitting diode having a base, a light-emitting chip and an elongated body secured to said base and enclosing said chip; and a reflector individual to said light-emitting diode and received in said head, said reflector having a generally cup-shaped internal surface surrounding an axis of said body and opening in a direction of a light emitting end of said head, said surface having a first conical part surrounding said light-emitting diode at said chip, a second conical part spaced from said first part along said axis toward said light-emitting end of said head, and a cylindrical part between the first and second conical parts.

16. A lamp comprising:

an elongated bar-shaped housing having an external surface;

a lamp head at an end of said housing containing at least one light source;

a switch on said housing having an actuator on said surface for controlling illumination of said source; and a clip on said housing covering said actuator and displaceable relative to said housing in at least one operation selected from rotation, linear shifting and removal to uncover said actuator for operation thereof.

* * * * *